US006499271B1

(12) United States Patent
Lastovich et al.

(10) Patent No.: US 6,499,271 B1
(45) Date of Patent: Dec. 31, 2002

(54) TRAY SEALING MACHINE

(75) Inventors: Mark S. Lastovich, Rockford, MI (US); Perry R. DeYoung, Ada, MI (US)

(73) Assignee: Oliver Products Company, Grand Rapids, MI (US)

( * ) Notice: Subject to any disclaimer, the term of this patent is extended or adjusted under 35 U.S.C. 154(b) by 101 days.

(21) Appl. No.: 09/599,827

(22) Filed: Jun. 22, 2000

Related U.S. Application Data

(63) Continuation-in-part of application No. 09/389,202, filed on Sep. 2, 1999, now abandoned, which is a continuation-in-part of application No. 09/103,859, filed on Jun. 24, 1998, now Pat. No. 5,946,887, which is a continuation of application No. 08/629,269, filed on Apr. 8, 1996, now Pat. No. 5,784,858.

(51) Int. Cl.[7] ..... B65B 51/10
(52) U.S. Cl. ..... 53/329.2; 53/373.7
(58) Field of Search ..... 53/329, 329.2, 53/373.7, 390, 478, 485, 287

(56) References Cited

U.S. PATENT DOCUMENTS

| | | | | |
|---|---|---|---|---|
| 796,833 | A | | 9/1905 | Ruff |
| 1,946,452 | A | | 2/1934 | Bridges |
| 2,847,113 | A | | 8/1958 | Dumas |
| 2,858,006 | A | | 10/1958 | Kalbow |
| 2,940,327 | A | | 6/1960 | Gartner |
| 3,283,469 | A | | 11/1966 | McBrady et al. |
| 3,378,991 | A | | 4/1968 | Anderson |
| 3,392,506 | A | | 7/1968 | Haines |
| 3,685,254 | A | | 8/1972 | Currier et al. |
| 3,706,175 | A | | 12/1972 | Anderson |
| 3,792,567 | A | | 2/1974 | Balcome |
| 3,834,521 | A | | 9/1974 | Rauch et al. |
| 3,860,108 | A | | 1/1975 | Farfaglia |
| 3,975,887 | A | | 8/1976 | Clymer |
| 4,033,092 | A | | 7/1977 | Vetter |
| 4,056,922 | A | | 11/1977 | Schilte |
| 4,189,279 | A | * | 2/1980 | Anderson |
| 4,194,341 | A | * | 3/1980 | Kihnke et al. |
| 4,196,561 | A | * | 4/1980 | Kruse |
| 4,583,350 | A | * | 4/1986 | Artusi et al. |
| 4,787,128 | A | * | 11/1988 | Wickham |
| 4,872,548 | A | * | 10/1989 | Masuda et al. |
| 4,989,393 | A | * | 2/1991 | Sell et al. |
| 4,991,375 | A | * | 2/1991 | Raque et al. |
| 5,010,714 | A | * | 4/1991 | Medwed et al. |
| 5,241,801 | A | * | 9/1993 | Nelson |
| 5,345,747 | A | * | 9/1994 | Raque et al. |
| 5,385,003 | A | | 1/1995 | Nixon, Jr. et al. |
| 5,597,428 | A | | 1/1997 | Matsumoto et al. |
| 5,682,729 | A | | 11/1997 | Buchko |
| 5,784,858 | A | | 7/1998 | Lastovich et al. |
| 5,890,349 | A | * | 4/1999 | Heisler et al. |
| 5,946,887 | A | | 9/1999 | Lastovich et al. |
| 5,953,886 | A | | 9/1999 | Eppler |
| 6,021,629 | A | | 2/2000 | Sterner, Sr. |
| 6,155,322 | A | * | 12/2000 | Landan et al. |

OTHER PUBLICATIONS

Drake Packaging Machinery brochure on Interchangeable Pocket Trayveyor—publication date 1980 or prior.
Drake Packaging Machinery Instruction and Repair Parts Manual—publication in 1975 or prior.

* cited by examiner

*Primary Examiner*—Eugene Kim
(74) *Attorney, Agent, or Firm*—Price, Heneveld, Cooper, DeWitt & Litton

(57) ABSTRACT

A container and lid sealing apparatus comprising a frame structure including a sealing position, support beams, a shiftable container support which includes a container retainer and shiftable on drawer rails from a position for loading and unloading a container into and out of the retainer, to the sealing position for sealing a lid on the tray, an upper heater platen suspended above the tray support, and an actuator actuable to force the upper heater platen downwardly with force onto a container and lid on the support. The force is equally distributed on all portions of the platen to seal a lid onto a container. The actuator may be either a manual actuator or an air actuator. The actuator is multi-axially pivotally coupled to the platen to thereby allow the platen to rock and seek and obtain a parallel relation with the container flange and lid.

30 Claims, 10 Drawing Sheets

TRAY SEALING MACHINE

CROSS-REFERENCE TO RELATED APPLICATION

This application is a continuation-in-part of U.S. patent application Ser. No. 09/389,202 filed on Sep. 2, 1999 now abandoned, entitled DRAWER ACTION TRAY SEALING MACHINE, which is a continuation-in-part of U.S. patent application Ser. No. 09/103,859 filed on Jun. 24, 1998, entitled DRAWER ACTION TRAY SEALING MACHINE, now U.S. Pat. No. 5,946,887, which is a continuation of U.S. patent application Ser. No. 08/629,269 filed on Apr. 8, 1996, entitled DRAWER ACTION TRAY SEALING MACHINE, now U.S. Pat. No. 5,784,858. Priority under 35 U.S.C. §120 is claimed to the filing dates of the '202, '859 and '269 applications and the entire disclosures of which are incorporated herein by reference.

BACKGROUND OF THE INVENTION

This invention relates to a machine for sealing a lid on a container, and more particularly for sealing food or the like in the container.

Food containers used by fast food establishments, grocery stores, delicatessens and the like, when filled on site, commonly employ a tray-type container integrally connected to a cover or lid. These containers are handy but do not seal the food in or seal air out. Consequently spillage readily occurs and retention of freshness is not possible. Another type of common container is that which has a separate lid which is snapped into place between the specially formed lid and container. Some containers of this type are leak resistant, but do not totally seal the contents. In large food processing establishments, containers can be completely sealed utilizing sealing machines which are presently known, but these typically are complex apparatuses, not suitable for on-site use in fast food restaurants, grocery stores, and the like. Persons employed at fast food establishments and the like are frequently young, relatively unskilled persons who work at a rapid pace. Turnover rate of employees is generally high, resulting in a high level of inexperience. Therefore, any mechanical devices to be used to close and seal containers at these establishments should be simple, easy and safe to use. There is needed an apparatus which meets these criteria as well as providing a leakproof or leak resistant container which also preserves freshness of the food item as well as assists in retaining heat with the food item.

One type of known apparatus usable in grocery stores, to seal a polymeric film lid onto the top rim of a container for containing and transporting food, uses a heated platen. If the tray is plastic, it can be made leakproof and airtight. If it is paperboard, it can be made leak resistant. The apparatus involves a fixed lower support serving as a tray carrier and having a well or cavity to receive and retain a container therein, and the upper heated platen pivotally mounted to shift to a closed position on the. container and lid between the platen and the lower support. The heated platen is manually forced down and held down by the weight of the human operator onto the container and lid during a time period while heat is applied to seal the lid to the container.

However, in order to provide sufficient force on the container and lid to fully compress the periphery of the two together, the heated upper platen must be manually forced down by the operator with a significant force which is usually about 20–40 pounds. By using leverage-type mechanical advantage, the force applied to the container and lid can be about 75 pounds. This exertion is required for each tray and lid, and for a set time period, in order to force the platen and tray carrier fully together. Establishments which would use these units frequently employ teenage persons or ladies, so that applying this significant amount of force steadily on the platen is difficult, requiring considerable exertion, and is particularly tiring. Moreover, it has been determined that even the application of this much force is sometimes not sufficient to assure a complete seal of the lid periphery to the container periphery. To be certain of sealing, the force should actually be several times this amount. One of the variables that can prevent total sealing is the fact that the flange of the tray might not be of uniform thickness around its periphery, resulting in a poor seal at the thinner areas.

SUMMARY OF THE INVENTION

An object of this invention is to provide a container sealing device which is rapid in operation, simple to use, requires little skill and is safe. The sealing device is particularly suitable for fast food restaurants, grocery stores, delicatessens, meat markets, senior meals programs and the like, to seal the contents of the container against leakage from the container, and preferably against air entry into the container. It rockingly adjusts automatically to apply equal pressure to all areas of the tray flange.

The sealing machine has a slide drawer which serves as a tray carrier on which a container and lid are placed and retained, the tray carrier being readily slidable on drawer rails into a sealing position from a load-unload position. An upper heated platen is shiftable downwardly by an actuator to apply a great force to the center of the heated platen and hence to the container and lid. The platen is suspended from a horizontal beam of a support structure so as to be able to swing as necessary to seek a parallel relationship with the container and lid flanges and thereby apply uniform pressure to the peripheral sealing regions of the container and lid. The actuator may be manual or be an inflatable air actuator.

These and other features, advantages, and objects of the present invention will be further understood and appreciated by those skilled in the art by reference to the following specification, claims, and appended drawings.

DESCRIPTION OF THE PREFERRED EMBODIMENTS

Figure 1:
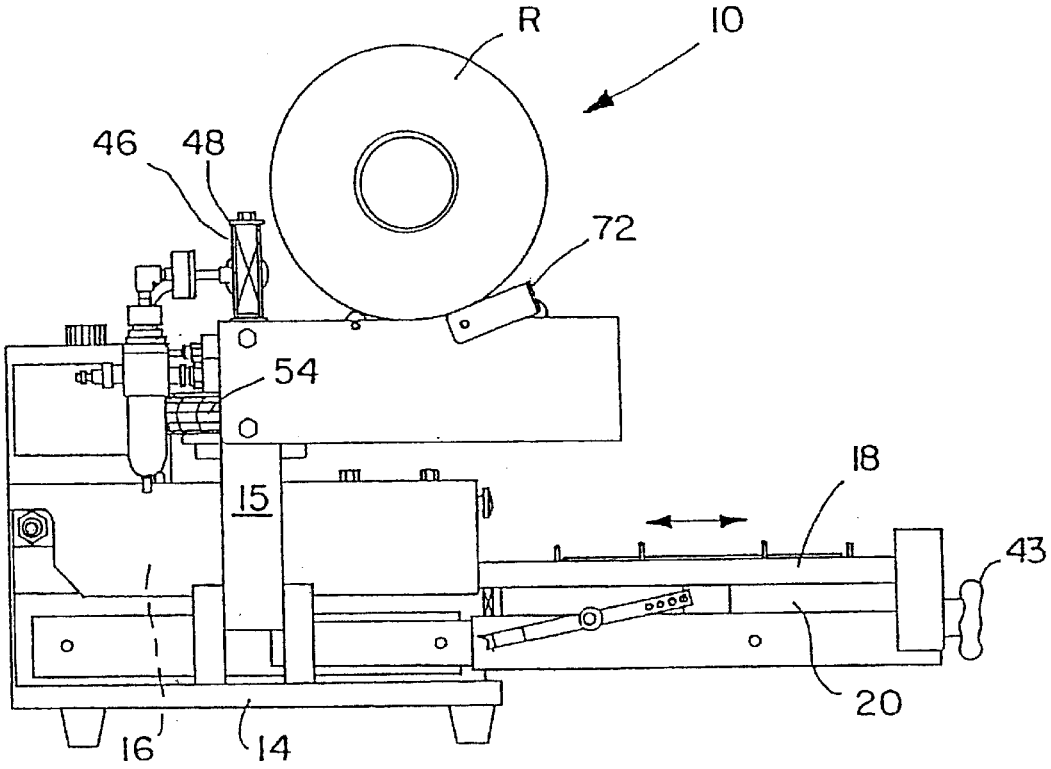
FIG. 1 is a side elevational view of an apparatus constructed in accordance with a first embodiment of the present invention.
Figure 2:
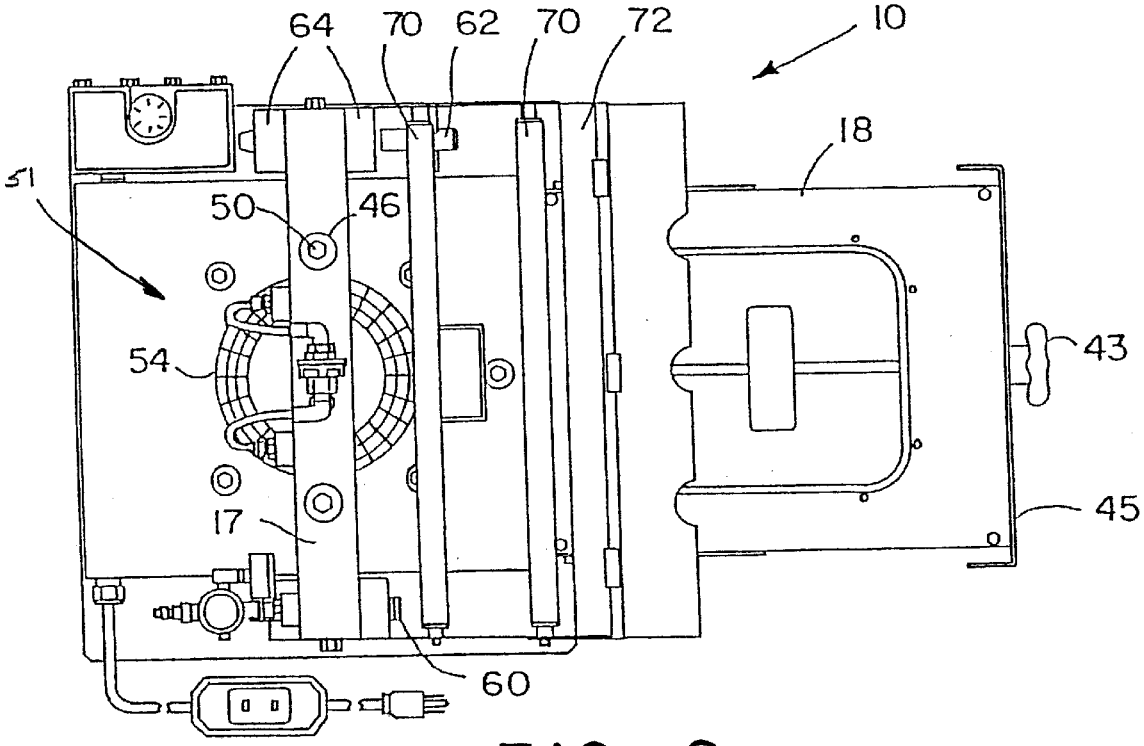
FIG. 2 is a top plan view of the apparatus of the first embodiment.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 7:
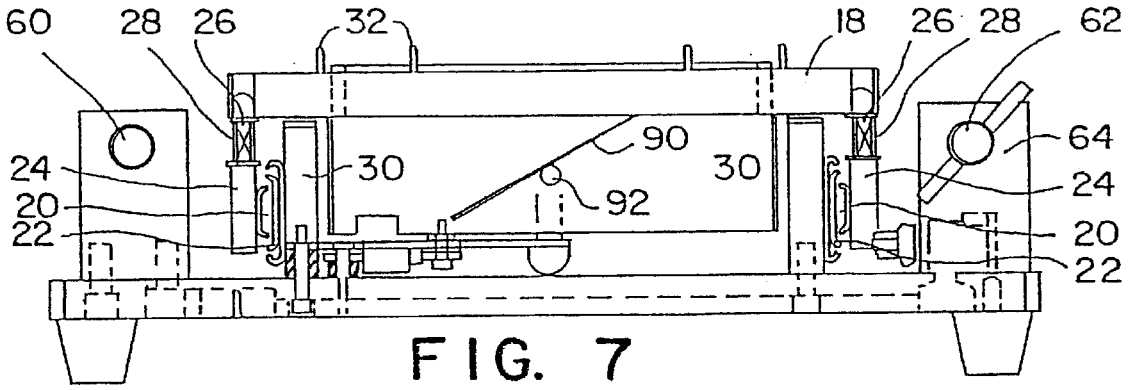
FIG. 7 is a front end elevational view of the lower portion of the apparatus of the first embodiment.

The reference numbered 10 generally designates a first embodiment of the novel sealing apparatus. The sealing apparatus 10 is shown having a support frame 14 which defines a sealing location or position 16 into which and out of which a lower tray support 18 can be moved. Tray holder 18 is indirectly mounted on a pair of drawer rails 20 (FIGS. 6 and 7) which telescopically cooperate with fixed case rails 22 for movement between the two positions, i.e., sealing position and load-unload position (FIG. 1). The drawer rails 22 are actually attached to the inside faces of a pair of elongated bars 24. Tray holder 18 is mounted above and on bars 24 with upstanding pins or studs 26 (FIG. 7), resting on compression springs 28 around the pins. Downward force on tray holder 18 depresses it against the bias of springs 28, with movement on pins 26, until the tray holder abuts the top surfaces of stops in the form of a pair of elongated, upstanding, fixed, rigid beams 30 mounted to frame 14 and located at the sealing position 16. Beams 30 are parallel to bars 24. With this arrangement, the tray holder 18 can be readily moved into and out of the sealing position 16 on the drawer rails 22 but, under significant downward force applied to the tray holder by the upper platen, the tray holder will be depressed against the bias of springs 28 onto these laterally spaced, parallel beams 30 which will supply support so as to prevent damage to the drawer rail assembly.

Tray holder 18 (FIG. 6) defines a desired number of container receiving cavities, shown here to be two, each cavity being surrounded by a peripheral ledge which is surrounded by a plurality of depressible locator pins 32. When a container having a peripheral shape like that of the cavity is placed therein, its peripheral, horizontal flange will rest on the peripheral ledge around the cavity, bounded by the pins 32. A lid of configuration like that of the container flange is placed thereon, also retained within locator pins 32 for alignment.

Figure 4:
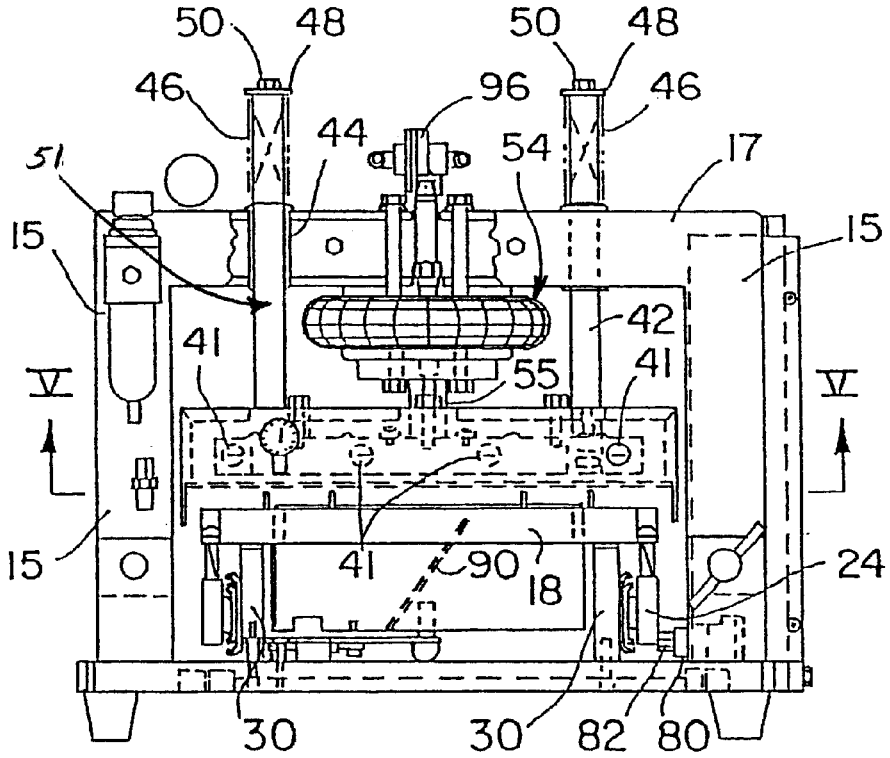
FIG. 4 is another front elevational view showing internal components of the first embodiment.
Figure 5:
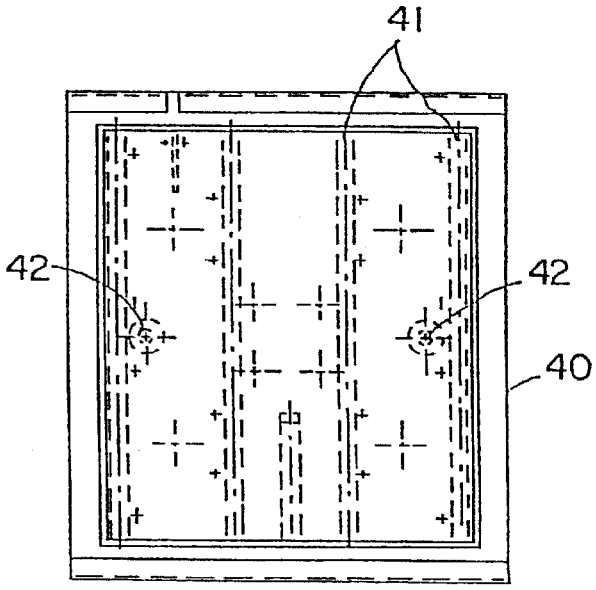
FIG. 5 is a bottom view of the upper platen of the first embodiment.
Figure 8:
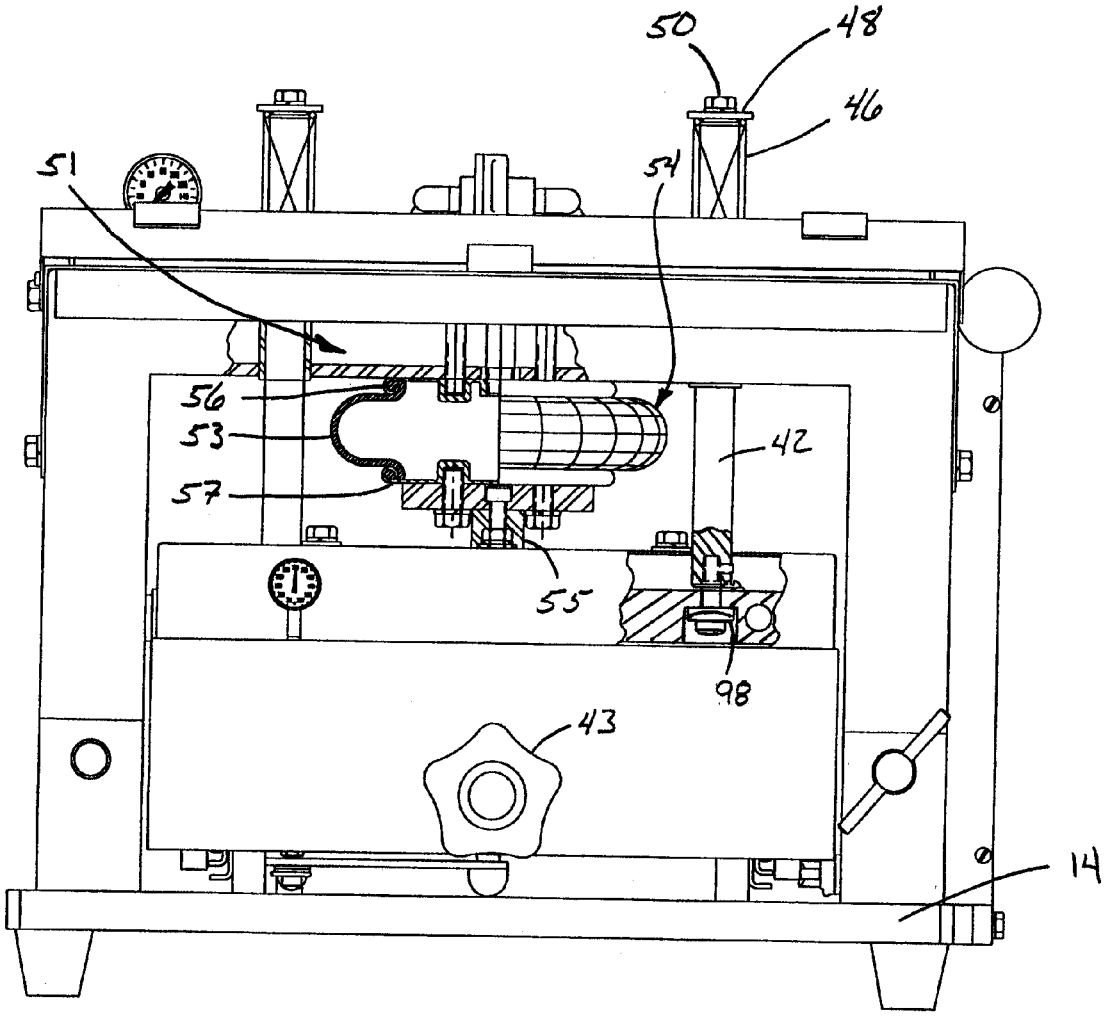
FIG. 8 is a front elevational view showing internal components of the first embodiment.

At the sealing position 16 is a heated upper platen 40 suspended on two laterally spaced rods 42. These rods 42 are loosely fit within sleeves 44 (FIG. 4) and are vertically slidable in sleeves 44 to allow vertical movement of platen 40. As shown in FIG. 8, rods 42 are attached to platen 40 using spherical washers 98, which allows platen 40 to multi-axially pivot freely front to back and side to side relative to rods 42.

Downward movement of the platen 40 and rods 42 is against the bias of compression springs 46 around rods 42. The bottom ends of the springs 46 are on a top 102 of a fixed, elongated, horizontal member 17 forming part of support structure 14 and extending transversely of the structure. Member 17 is located at the top of a pair of upstanding support columns 15 (FIG. 4) above the upper platen 40. Springs 46 are trapped between support 17 and washers 48 on the upper end of rods 42, the washers being held in position by bolts 50 threaded into rods 42. Downward pressure on platen 40 thus will compress springs 46 against the bias thereof, this downward pressure being applied by an actuator 51 that includes an air actuator 54 mounted between support 17 and platen 40. Inflation of the air actuator 54 by injection of air under pressure lowers upper platen 40 down onto lidded trays on tray holder 18. As shown in FIG. 8, air actuator 54 includes a flexible rubber baffle 53 positioned between two rigid plates 56 and 57. Because plates 56 and 57 are flexibly joined by only baffle 53, plates 56 and 57, and hence, support 17 and platen 40, may move into non-parallel positions relative to one another and "rock" as needed to allow platen 40 to seek and obtain a parallel relation with the container flange and lid.

Actuator 51 has a centrally positioned rod 55 engaging the top center of platen 40. Therefore, downward pressure of actuator 54 on rod 55 creates a balanced pressure by all portions of platen 40 against all portions of the tray and lid even when plates 56 and 57 of actuator 51 are not parallel, since platen 40 can rock (i.e., pivot or swing) due to the manner in which it is suspended from horizontal member 17 and air actuator 54, as necessary to always seek a parallel relationship to the support and a container flange and lid thereon. This ability of the platen to rock enables the platen to place uniform pressure on all parts of the flange and contacting lid areas. The upper platen includes a plurality of resistance heater elements 41 (FIG. 4), so that heat and pressure can be applied to the lid and the peripheral rim of the tray in cavity 34, to seal the lid to the tray container.

Figure 3:
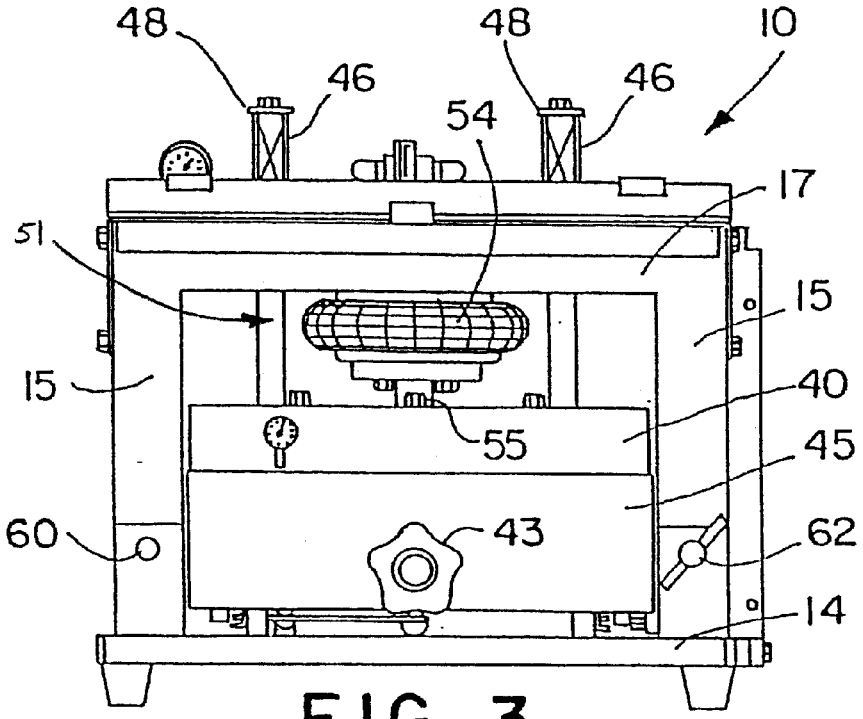
FIG. 3 is a front end elevational view of the apparatus of the first embodiment.

Support 17 is mounted at one of its ends to one column 15 with a pivot pin 60 (FIG. 3), and at the other end to the other column 15 by a removable lock pin 62. Lock pin 62 extends through a pair of rigid mounting ears 64, as well as through the one end of support 17. Removal of the lock pin 62 allows support 17 and the upper platen to be pivoted laterally on pin 60 for cleaning, repair or the like. The lower support 18 is also removable for cleaning, substitution of a support with a different size and/or shape recess, or otherwise, simply by releasing the drawer rails in a conventional manner.

The frame structure also includes a pair of upper roller bars 70 extending transversely of the apparatus and parallel to each other, for mounting a roll R of interconnected lids thereon. These lids are separable along perforations (not shown) so that the operator can grasp the endmost portion of the roll, pull it beneath a retaining bar 72 and detach the end lid portion from the roll along the perforations, then place the lid on a container in cavity 34, and aligned within the pins 32. A friction brake on retaining bar 72 prevents the film from moving in reverse on the roll. These pins are depressible into support 18 when upper platen 40 is lowered by air actuator 54. The lids are normally of plastic material with a heat sealable layer, or a material such as paperboard coated with a heat sensitive sealable layer, to bond to the container flange when heated and pressed.

On the front end of tray support 18 is a rotational knob 43 for manual actuation to eject the finished tray from cavity 34 for grasping the tray. Specifically, by rotating knob 43, rod 92 and transverse element 90 are rotated, the latter engaging and lifting the tray. Also on the front face of tray support 18 is an upright protector panel 45 which closes adjacent the vertical panel on the front face of platen 40 when the support is moved inwardly to the sealing position, to close off the front face of the sealing apparatus and prevent injury to persons during vertical movement of heated upper platen 40.

Figure 6:
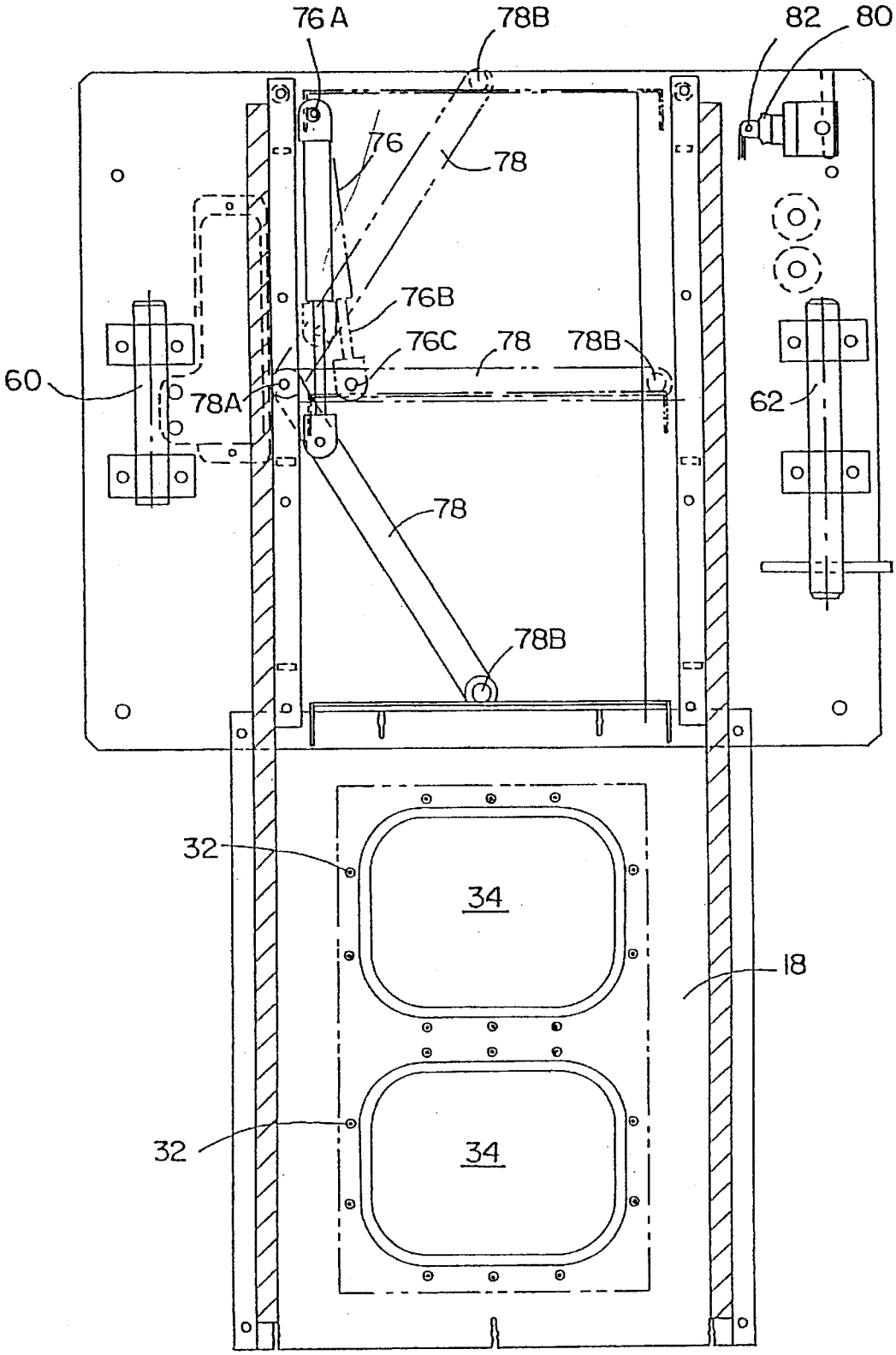
FIG. 6 is a sectional plan view of the apparatus of the first embodiment.

A gas spring 76 for shifting the container support from its sealing position back to the extended load-unload position is attached between frame 14 and a pivotal link 78 (FIG. 6). More specifically, one end 76A of gas spring 76 is pivotally attached to frame 14, with the extended end of its piston rod 76B (FIG. 6) being pivotally connected at 76C intermediate the ends of link 78. One end of link 78 is pivotally connected at 78A to frame 14 while the opposite end 78B has a roller cam engaging tray support 18, such that extension of the gas spring shifts the link and tray support from the sealing position to the load-unload outer position, such movement being shown by the three successive positions depicted in FIG. 6.

Figure 10:
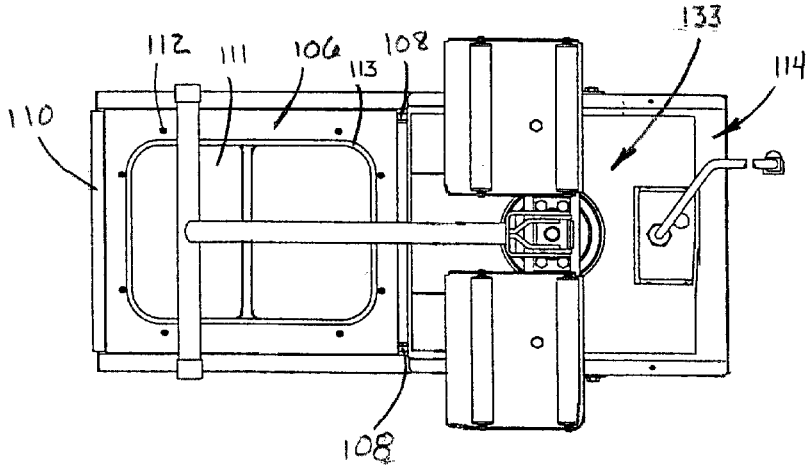
FIG. 10 is a top plan view of the apparatus of the second embodiment.

Downward movement of air actuator 54 of actuator 51 is controlled by opening of a valve 80 (FIG. 4) with a pneumatic cam valve switch 82 engaged by the inner end of one of the drawer supports 24 when the tray holder is moved into the sealing position. The force of air actuator 54 lowers upper platen 40 down against the container and lid on the tray support 18, forcing the lower platen down against the bias of springs 46 until it engages support beams 30. The time interval of actuation of the constant force air actuator 54 is controlled by a timer 83 (FIG. 10). At the end of this interval, timer 83 actuates a quick exhaust, i.e., air dump, valve 96 which instantly dumps the air from the air actuator 54 to immediately cause it to retract vertically upwardly under the bias of compression springs 46. Upon release of the downward pressure by the upper platen, gas spring 76 extends its piston rod to pivotally shift link 78 and thereby horizontally shift tray support 18 out of the sealing position to the extended load-unload position.

In operation, therefore, with the tray support in the extended load-unload position, a person places in cavity 34 an open top container having a peripheral flange (FIG. 1) to rest on the tray support. The container can be filled in place or can have contents already in it when so placed. The operator then pulls the end portion of roll R and separates the endmost lid from the roll, placing it on top of the container and flange, within the confines of pins 32. The lid and/or container flange have heat responsive sealing material thereon. The tray support, tray, contents and lid are then pushed into the sealing position, riding on the drawer rails. At this point the tray support engages cam 82 of pneumatic cam valve 80 to actuate the air logic system and cause air to enter air actuator 54. This lowers, i.e., depresses, the heated upper platen 40 against the bias of compression springs 46, down against the lid, container and tray support, forcing the tray support down against the bias of compression springs 28, onto the upper surfaces of rigid support beams 30. Heat and pressure are held for the preset time interval necessary to seal the lids to the containers. The actuator 51 causes a balancing of pressure to all portions of the tray flange and engaging lid by the floating, i.e., multi-axial rocking/pivoting, action of the platen 40 beneath actuator 54. Upon timed release of the air actuator 54, compressed air is discharged from the air actuator 54, the upper platen is vertically retracted by spring bias, allowing gas spring 76 to horizontally eject the tray support along with its sealed container and contents from the sealing position to the load-unload position. At this point, the container can be made to partially protrude above tray support 18 by manual rotation by the operator of knob 43 and thus element 90 (FIG. 7) on pivot shaft 92, enabling the operator to grasp the sealed container. The unit is then ready for reloading. The operation is quick, simple and easy to learn. The sides and front of the unit are provided with guards to prevent the operator's hands from entering the sealing position area. Although the apparatus has been largely described using a tray type flanged container, other containers than trays could be sealed.

Figure 9:
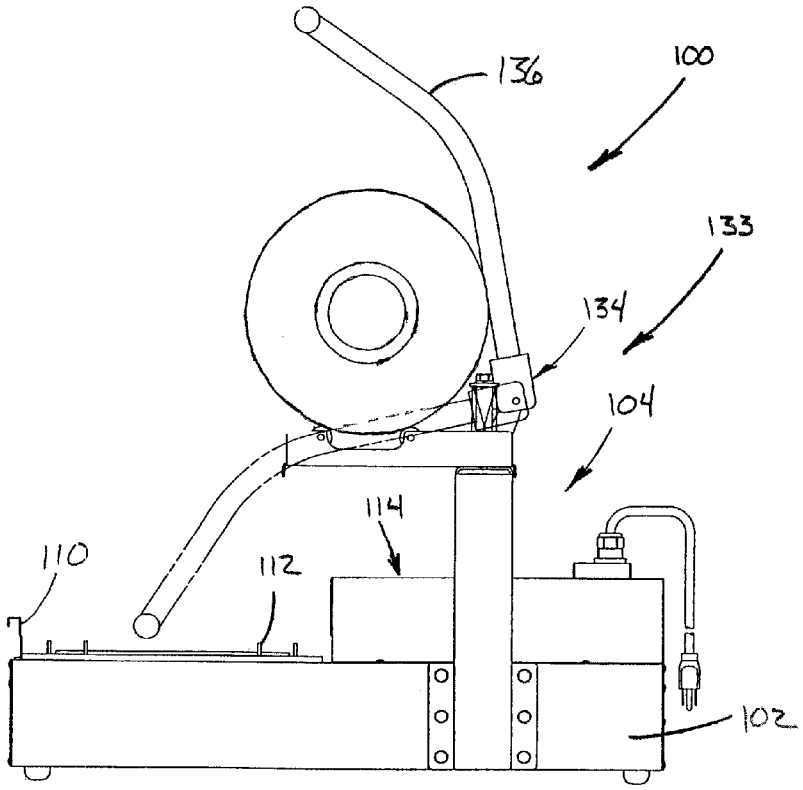
FIG. 9 is a side elevational view of an apparatus constructed in accordance with a second embodiment of the present invention.

The reference 100 (FIG. 9) generally designates a second embodiment of the novel sealing apparatus. The sealing apparatus 100 is shown having a support frame 102 which defines a sealing location or position 104 into which and out of which a lower tray support or holder 106 (FIG. 10) can be moved. Tray holder 106 is supported on a pair of rails 108 which are attached to the inside faces of support frame 102. A handle 110 is fixedly attached to tray support 106, thereby allowing easy manipulation of tray support 106 along rails 108. With this arrangement, the tray holder 106 can be readily moved into and out of the sealing position 104 on drawer rails 108.

Each tray holder 106 defines a desired number of container receiving cavities 111, shown here to be two, each cavity being surrounded by a peripheral ledge 113 which is surrounded by a plurality of depressible locator pins 112. It should be noted that while in the illustrated example each tray holder 106 is configured to hold a container within two cavities 111, containers having varied numbers of cavities in numerous arrangements may be used. When a container having a peripheral shape like that of the cavity 111 it is placed therein, its peripheral, horizontal flange will rest on the peripheral ledge 113 around the cavity 111, bounded by locator pins 112. A lid of configuration like that of the container flange is placed thereon, also retained within locator pins 112 for alignment.

At the sealing position 104 is a heated platen 114 (FIG. 11) suspended on two laterally spaced rods 116. These rods 116 loosely fit within sleeves 118 and are vertically slideable in sleeves 118 to allow vertical movement of platen 114. The rods 1 16 are attached to an upper plate 120 of platen 114 using spherical washers 122, which allows upper plate 120 to multiaxially pivot freely from front to back and side to side relative to rods 116.

Downward movement of the platen 114 and rods 116 is against the bias of compression springs 124 around rods 116. The bottom ends of the springs 124 are on the top of a fixed, elongated, horizontal member 126 forming part of support frame 102 and extending transversely of the structure. Member 126 is located at the top of a pair of upstanding support columns 128. Springs 124 are trapped between member 126 and washers 130 on the upper end of rods 116, the washers being held in position by bolts 132 threaded into rods 116. Downward pressure on platen 114 thus will compress springs 124 against the bias thereof, this downward pressure being applied by an actuator 133 that includes a manual actuator 134 mounted on member 126 and mechanically linked to platen 114. Manual actuator 134 of actuator 133 includes a handle 136 movable between an open position wherein platen 114 is raised and tray support 106 may be moved between the sealing position 104 and the load/unload position, and a closed position, as shown in phantom line in FIG. 9, wherein platen 114 is in a lowered position for sealing. Handle 136 is mechanically linked to upper plate 120 of platen 114 by a reciprocating actuator rod 138 that is loosely fit within a sleeve (not shown) similar to sleeves 118. A cammed mechanical linkage 140 connects handle 136 to actuator rod 138 such that movement of handle 136 between open and closed positions moves actuator rod 138 in a reciprocating linear manner.

Figure 12:
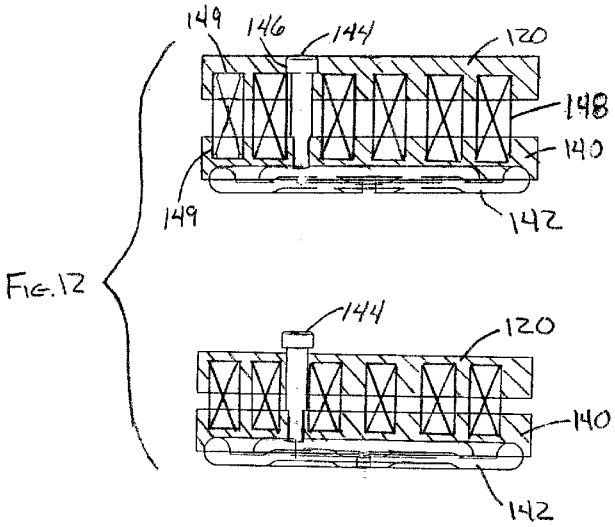
FIG. 12 is an enlarged cross-sectional view of the platen of the second embodiment shown in open and closed positions.
Figure 13:
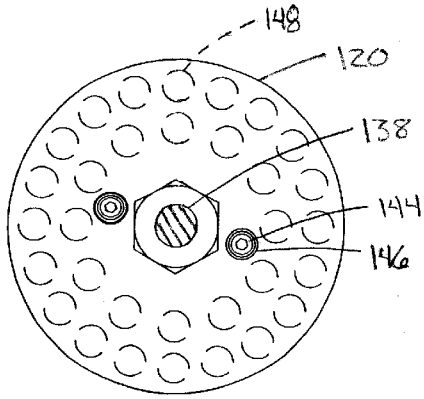
FIG. 13 is a cross-sectional view of an upper plate of the platen of the second embodiment, taken through line XIII—XIII, of FIG. 11.

Platen 114 further includes a lower plate 140 that includes a heating element 142 (FIG. 12). Lower plate 140 is connected to upper plate 120 by a pair of bolts 144 that loosely fit within a pair of apertures 146 within upper plate 120 and are threadably engaged within lower plate 140. Actuator 133 further includes a plurality of springs 148 that are located within a plurality of recesses 149 within plates 120 and 140 and bias plates 120 and 140 away from one another. In the example illustrated in FIG. 13, springs 148 are placed in two concentric, circular patterns, however, springs 148 may be placed between plates 120 and 140 in other arrangements. Because plates 120 and 140 are flexibly joined by bolts 144 that loosely fit within apertures 146 of plate 120, upper plate 120 and lower plate 140 may move into non-parallel positions relative to one another, and "rock" as needed to allow the heating element 142 to seek and obtain a parallel relation with the container flange and lid.

The plurality of springs 148 create the only force exerted on lower plate 140 and hence heating element 142. Therefore, downward pressure of actuator 133 creates a balanced pressure by all portions of heating element 142 against all portions of the tray and lid even when upper plate 120 and lower plate 140 are not parallel, since lower plate 140 can rock (i.e. pivot or swing) as necessary to always seek a parallel relationship to the tray support 106 and a container flange and lid thereon due to the manner in which it is suspended from upper plate 120 and manual actuator 134. This ability of the platen to rock enables the platen to place uniform pressure on all parts of the flange and contacting lid areas.

Figure 11:
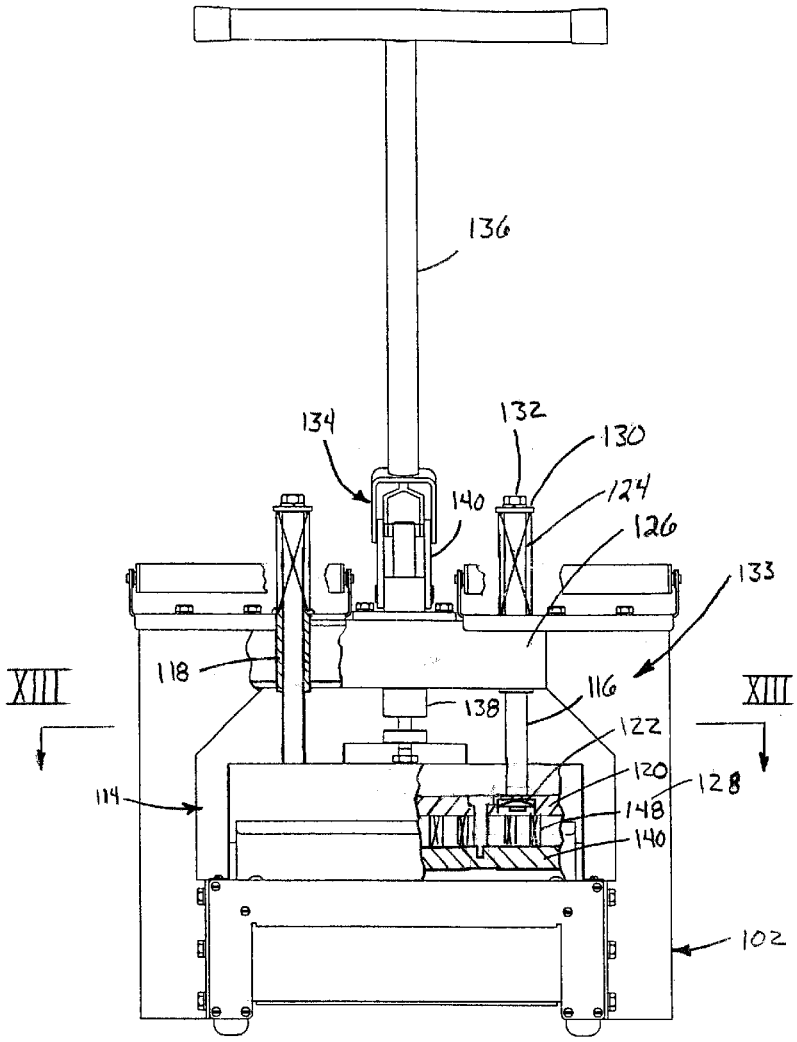
FIG. 11 is a front elevational view showing internal components of the second embodiment.
Figure 14:
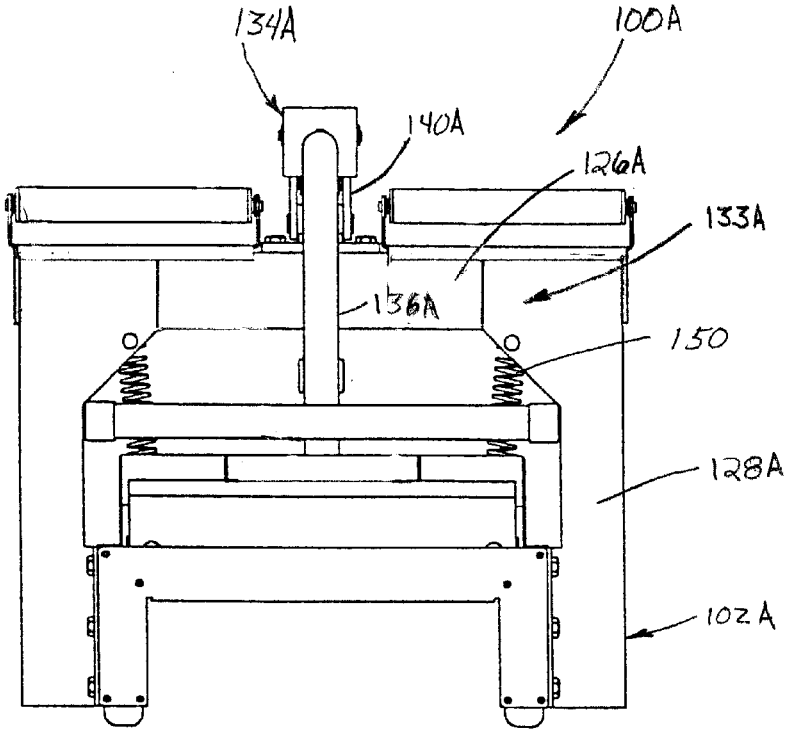
FIG. 14 is a front end elevational view of an apparatus constructed in accordance with a third embodiment of the present invention.
Figure 15:
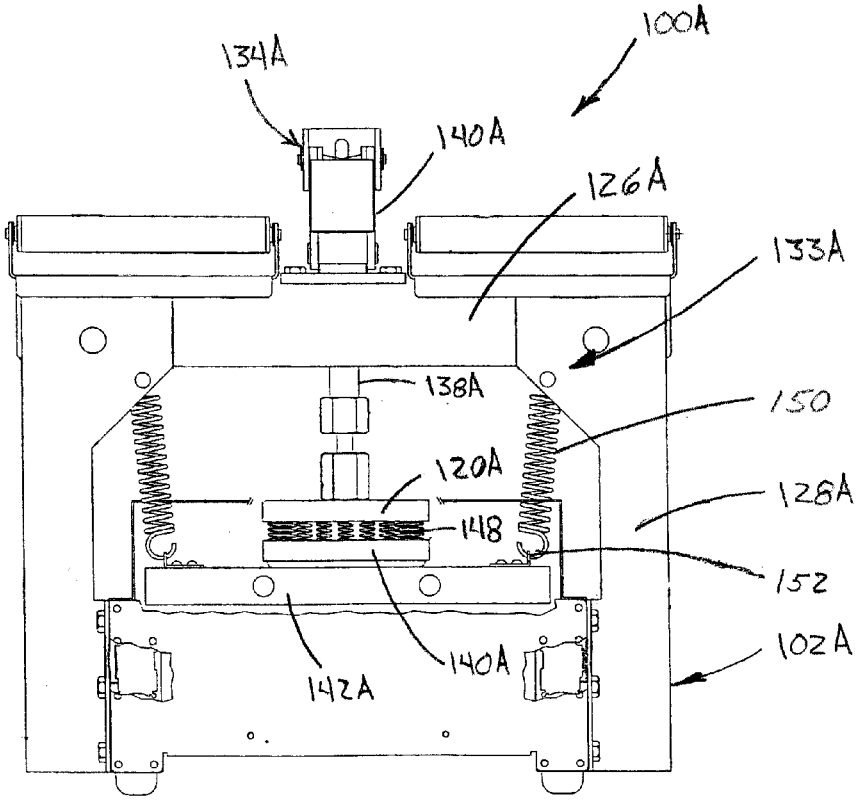
FIG. 15 is a front end elevational view showing internal components of the third embodiment.

The reference 100A (FIG. 14) generally designates another embodiment of the novel sealing apparatus. Since sealing apparatus 100A is similar to previously described sealing apparatus 100, similar parts appearing in FIGS. 14 and 15 and FIG. 11 are represented by the same, corresponding reference numeral, except for the suffix (A) in the numerals of the latter. In sealing apparatus 100A, a pair of springs 150 are used in place of rods 116 (FIG. 11), sleeves 118, and springs 124. Springs 150 (FIG. 15) are fixedly attached to support columns 128A of support frame 102A, and eyelets 152 fixedly attached to the top of heating element 142A. Because upper plate 120A and lower plate 140A are flexibly joined by loosely fitting bolts (not shown) similar to plates 120 and 140 (FIG. 12), plates 120A and 140A, and hence, heating element 142A and upper plate 120A may move into non-parallel positions relative to one another and "rock" is needed to allow heating element 142A to seek and obtain a parallel relationship with the container flange and lid. A downward pressure of manual actuator 134A on actuator rod 138A creates a balanced pressure by all portions of heating element 142A against all portions of the tray and lid, even when upper plate 120A and lower plate 140A are not parallel, since lower plate 140A can rock (i.e., pivot or swing) due to the manner in which it is suspended from upper plate 120A, thereby allowing heating element 142A to always seek parallel relationship with a support and container flange and lid thereon. This ability of the platen to rock enables the platen to place uniform pressure on all parts of the flange and the contacting lid areas.

Figure 16:
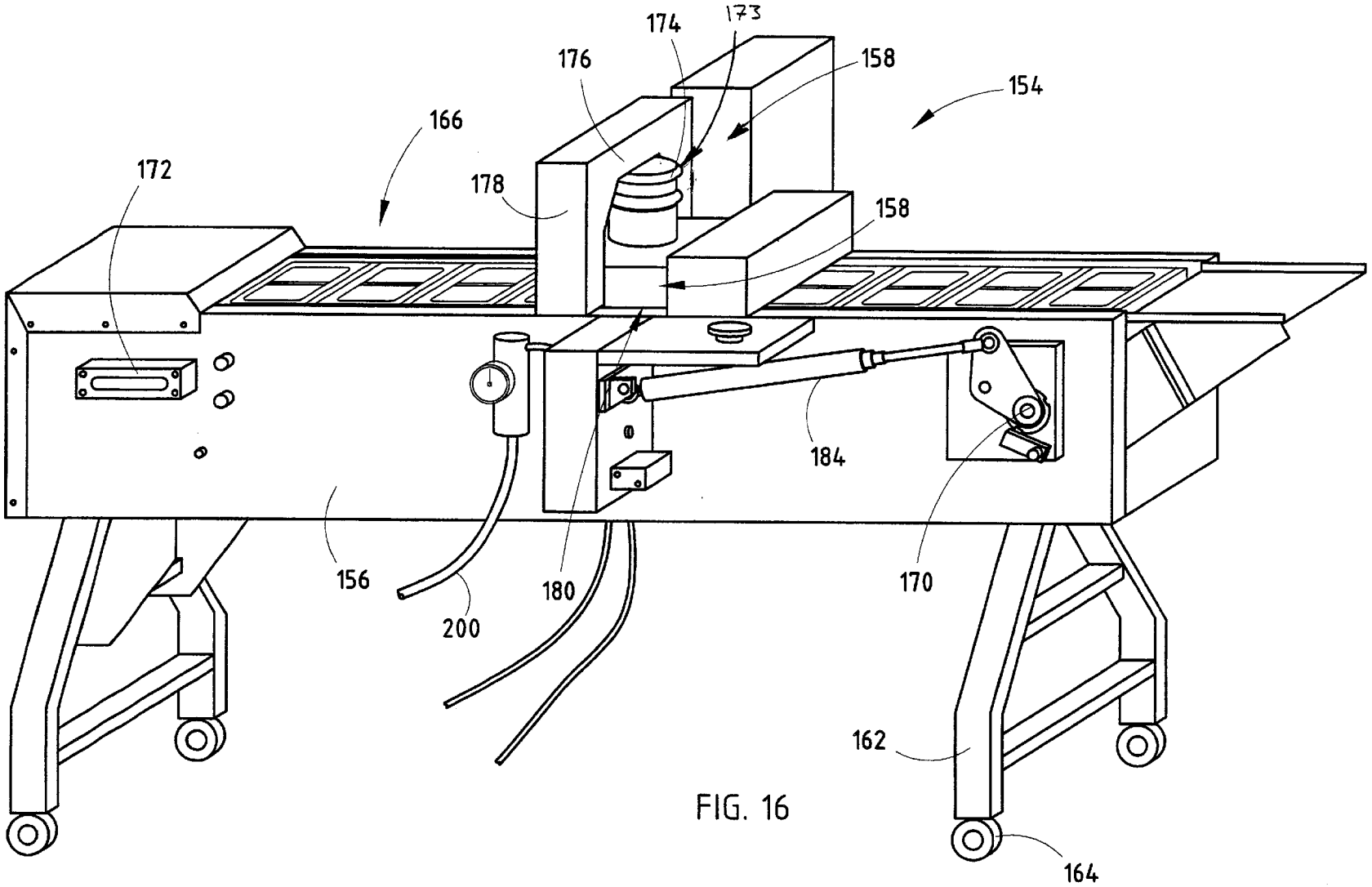
FIG. 16 is a top perspective view of an apparatus constructed in accordance with a fourth embodiment of the present invention.

The present inventive sealing apparatus that includes air actuator 53 (FIG. 8) and/or actuator 133 plates 120 and 140 and springs 148 (FIG. 11) positioned therebetween, may also be utilized within an auto-feed tray sealer 154, as shown in FIG. 16. The tray sealer 154 includes an elongated supporting frame 156 and a sealing apparatus 158 positioned along supporting frame 156 to define a sealing location or position 160 therebetween. Supporting frame 156 is supported above the ground by a plurality of legs 162 that each may include a roller or wheel 164 attached thereto. Supporting frame 156 is trough-shaped and defines an open top 166. A plurality of tray supports or holders 168 each define a desired number of container receiving cavities. 169, shown here to be two. As previously noted, although the illustrated example is for use with containers which each contain two separate food compartments or cavities, numerous constructions and layouts may be used. When a container having a peripheral shape like that of the cavities 169 is placed therein, its peripheral, horizontal flange will rest on the peripheral ledge around the cavities 169. The tray supports 168 are driven along opening 166 and through sealing position 160 by a pair of drive chains (not shown) juxtaposed across supporting frame 156. The drive chains are supported and driven by a plurality of drive gears that are in turn supported and driven by a first rotating shaft 170 and a second rotating shaft 172 positioned at opposite ends of supporting frame 56.

As illustrated, the sealing apparatus 158 is constructed similarly to sealing apparatus 10 (FIG. 4) and includes an actuator 173 that includes an air actuator 174 mounted between a horizontal support member 176 which is supported by vertical support members 178, and a platen 180. Alternatively, sealing apparatus 158 may also include a dual plate and spring assembly similar to actuator 133 and plates 120 and 140 and springs 148 (FIG. 11) as discussed above. As discussed above, the sealing apparatus 158 is constructed to have a platen that rocks and thereby uniformly engages a peripheral region of the container.

Figure 17:
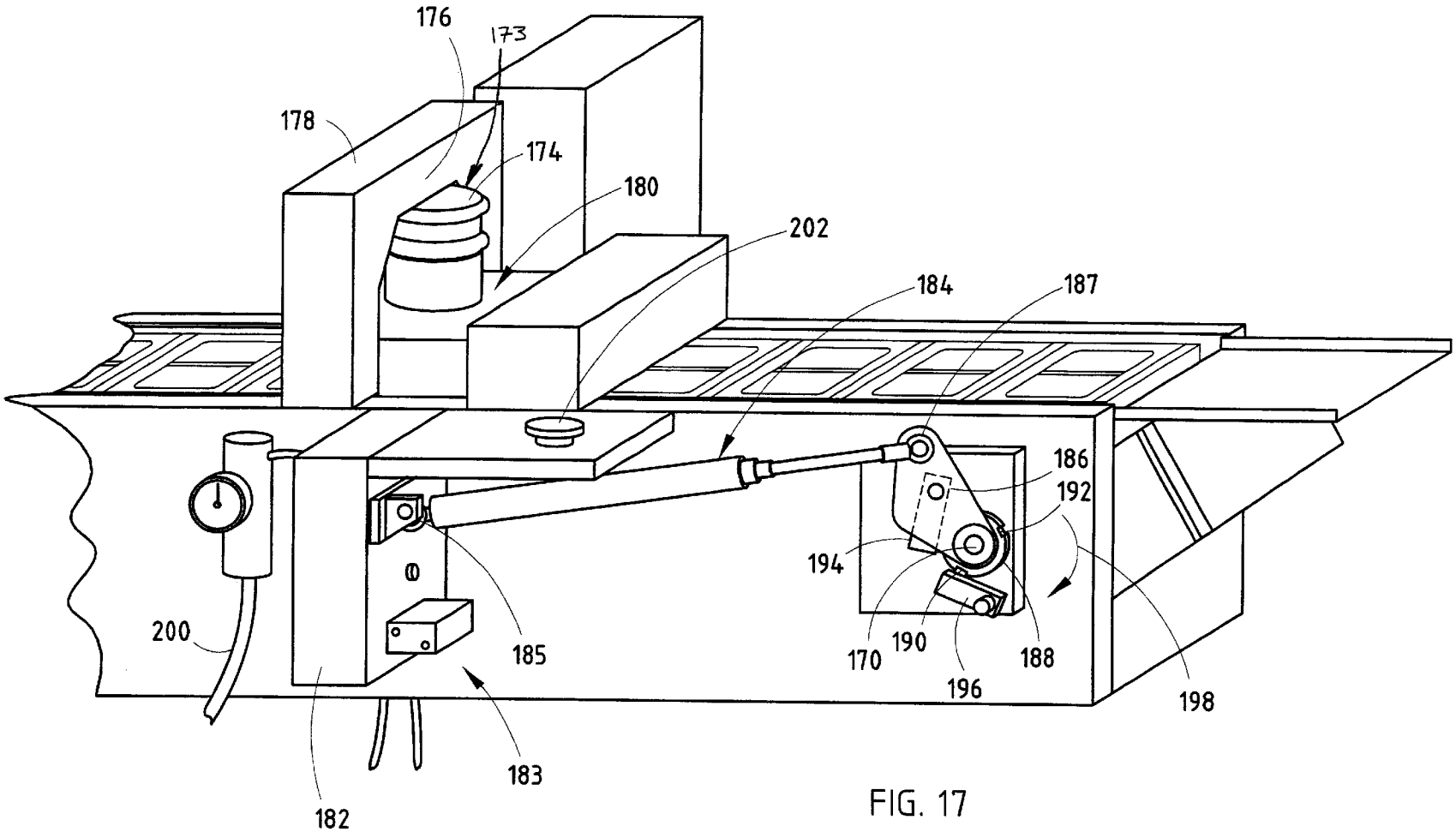
FIG. 17 is an enlarged top perspective view of the apparatus of the fourth embodiment.

The tray supports 168.are driven along supporting frame 156 by a pneumatic cylinder 184 which is. mechanically linked to shaft 170, and hence the drive chains (not shown). More specifically, pneumatic cylinder 184 (FIG. 17) is pivotally attached at a first end 185 to an air logic circuit block 182 which form a portion of an air logic circuit 183, and pivotally attached at a second end 187 to crank 186. The crank 186 is fixedly attached to shaft 170 such that rotation of crank 186 about shaft 170 causes shaft 170 to rotate, thereby causing the drive chains and tray supports 168 to move along supporting frame 156.

A disc-shaped stop block 188 is attached to shaft 170 to prohibit tray supports 168 "over-advanced" or "under-advanced," thereby ensuring proper alignment of each tray support 168 within sealing position 160. More specifically, stop block 188 is provided with a first notch 190 and a second notch 192. A first stop tab 194 and a second stop tab 196 are pivotally attached to supporting frame 156 and are adapted to engage first notch 190 and second notch 192.

In operation, as air cylinder 184 advances, crank 186 is rotated in a clockwise direction 198 until first stop tab 194 engages first notch 190 within stop block 188, thereby prohibiting stop block 188 and shaft 170 from rotating, thus ensuring that tray supports 168 cannot advance beyond a certain point along supporting frame 156. Through experimentation it has been discovered that the impact force between stop block 188 and first stop tab 194 can cause shaft 170 to recoil or react in a counter-clockwise motion, thereby moving tray support 168 out of the desired location within sealing position 160. Second stop tab 196 engages second notch 192, thereby prohibiting shaft 170 from reversing its rotation due to the impact, thus ensuring proper locating of each tray support 168 within sealing position 160.

The pneumatic cylinder 84 receives pressurized air through the pneumatic circuit block 182 which receives air via an air hose 200. The air logic circuit 183 is adapted to adjustably control the cycle time of the air cylinder, as well as to control the dwell time of the platen 180 within sealing apparatus 158. Air logic circuit 183 is provided with a variable control switch 202 which controls the cycle time of air cylinder 184, thus controlling the cycle time that each individual tray support 168 is located within sealing position 160, as well as the dwell time of the platen 180.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the Doctrine of Equivalents.

The invention claimed is:

1. A sealing apparatus comprising:

a fixed frame structure including a base and an actuator support extending upward from said base;

a container support including a container receiver;

an upper heater platen suspended from said actuator support above said container support, said upper heater platen being vertically shiftable to press a container and lid on said container support and being pivotable relative to said actuator support so as to slightly rock and thereby uniformly engage a peripheral region of the container and lid on said container support; and an air actuated actuator positioned above said platen to cause said platen to apply equal force against said container support over the platen area wherein said actuator includes an upper plate, a lower plate securely coupled to said upper heater platen, and a flexible baffle that flexibly suspends said lower plate from said upper plate and that together with said plates defines an air chamber for said air actuator.

2. A sealing apparatus comprising:

a base frame;

a container support including a container receiver, said container support being slidably disposed on said base frame so as to be horizontally movable between a sealing position and a non-sealing position;

an upper heater platen suspended above said container support at the sealing position; and actuator mounted above said upper heater platen and actuable to force said upper heater platen downwardly onto a container and lid on said container support to seal the lid onto the container on said support, said actuator including a coupling mechanism for pivotally coupling said actuator to said upper heater platen such that said platen is multi-axially pivotable with respect to a substantially horizontal plane and relative to said actuator.

3. The sealing apparatus as defined in claim 2, wherein said coupling mechanism includes a push rod, said push rod being multi-axially, pivotally coupled to said upper heater platen.

4. The sealing apparatus as defined in claim 3, wherein said coupling mechanism further includes an upper plate, a lower plate securely coupled to said upper heater platen, and means for flexibly suspending said lower plate from said upper plate.

5. The sealing apparatus as defined in claim 4, wherein said actuator further includes a plurality of springs disposed between said upper and lower plates.

6. The sealing apparatus as defined in claim 4, wherein said means for flexibly suspending said lower plate includes a pair of guide members loosely and slidably disposed in through respective apertures in one of said plates.

7. The sealing apparatus as defined in claim 6, wherein said guide members each include a head at an end thereof for limiting separation distance between said plates.

8. The sealing apparatus as defined in claim 7, wherein said actuator further includes a plurality of springs disposed between said upper and lower plates.

9. The sealing apparatus as defined in claim 8, wherein said actuator is manually actuated.

10. The sealing apparatus as defined in claim 9, wherein said manual actuator includes an elongated handle.

11. The sealing apparatus as defined in claim 10, wherein said base frame includes a base, vertical supports extending upward from said base, and a horizontal beam supported on said vertical supports, said elongated handle is pivotally coupled to said horizontal beam, and wherein said push rod slidably extends through an aperture in said horizontal beam.

12. The sealing apparatus as defined in claim 2, wherein said base frame includes a base, vertical supports extending upward from said base, and a horizontal beam supported on said vertical supports, said actuator is pivotally coupled to said horizontal, and wherein said coupling mechanism includes a push rod that vertically slides through an aperture in said horizontal beam to force said upper heater platen downward when said actuator is actuated by pivoting relative to said horizontal beam.

13. The sealing apparatus as defined in claim 2, wherein said container support is automatically shifted between a loading position and the sealing position located below the platen.

14. The sealing apparatus as defined in claim 13, wherein said container support is shifted by a pneumatic cylinder.

15. The sealing apparatus as defined in claim 14, and further including an air logic circuit, and wherein said actuator and said pneumatic cylinder are both controlled by said air logic circuit.

16. The sealing apparatus as defined in claim 14, wherein a first stop limits shifting of said container support in a first direction.

17. The sealing apparatus as defined in claim 16, wherein a second stop limits shifting of said container support in a second direction.

18. The sealing apparatus as defined in claim 2, wherein said container support is horizontally shiftable between a load/unload position and a sealing position below said platen.

19. The sealing apparatus as defined in claim 2 and further including two rods pivotally attached to said upper heater platen and extending vertically upward and passing through respective apertures in said actuator support.

20. The sealing apparatus as defined in claim 19 and further including a biasing mechanism for biasing said upper heater platen toward said actuator support and away from said container support.

21. The sealing apparatus as defined in claim 20, wherein said two rods each include a washer on an upper end and said biasing mechanism includes two biasing springs extending around said rods between a bottom surface of said washers and an upper surface of said actuator support so as to compress when said actuator is activated.

22. The sealing apparatus as defined in claim 2 and further including a biasing mechanism for biasing said upper heater platen toward said actuator support and away from said container support.

23. The sealing apparatus as defined in claim 2, wherein said actuator includes an air actuated actuator and further including a cam switch positioned to be actuated by said container support when moved to the sealing position, for controlled activation of said actuator.

24. The sealing apparatus as defined in claim 2, wherein said actuator includes an upper plate, a lower plate securely coupled to said upper heater platen, and means for flexibly suspending said lower plate from said upper plate.

25. The sealing apparatus as defined in claim 24, wherein said actuator further includes a plurality of springs disposed between said upper and lower plates.

26. The sealing apparatus as defined in claim 24, wherein said means for flexibly suspending said lower plate includes a pair of guide members loosely and slidably disposed in through respective apertures in one of said plates.

27. The sealing apparatus as defined in claim 26, wherein said guide members each include a head at an end thereof for limiting separation distance between said plates.

28. The sealing apparatus as defined in claim 27, wherein said actuator further includes a plurality of springs disposed between said upper and lower plates.

29. The sealing apparatus as defined in claim 28, wherein said actuator is manually actuated and includes a handle pivotally coupled to said upper plate and said actuator support.

30. The sealing apparatus as described in claim 2, wherein said container support is manually shifted between a load/unload position and a sealing position below the platen.

* * * * *

UNITED STATES PATENT AND TRADEMARK OFFICE

CERTIFICATE OF CORRECTION

PATENT NO. : 6,499,271 B1
DATED : December 31, 2002
INVENTOR(S) : Lastovich et al.

It is certified that error appears in the above-identified patent and that said Letters Patent is hereby corrected as shown below:

Column 3,
Line 40, “numbered” should be -- number --.

Column 6,
Line 46, delete “it”.
Line 56, “rods 1 16” should be -- rods 116 --.

Column 7,
Line 65, “is” should be -- as --.

Column 8,
Line 22, after “cavities” delete -- . -- (period).
Line 47, after “168” delete -- . -- (period).
Line 48, after “is” delete -- . -- (period).

Column 13,
Line 13, “cylinder 84” should be -- cylinder 184 --.

Column 10,
Line 41, after “horizontal” insert -- beam --.

Signed and Sealed this

Twenty-fifth Day of March, 2003

JAMES E. ROGAN
*Director of the United States Patent and Trademark Office*